US010924866B2

(12) United States Patent
Davis et al.

(10) Patent No.: US 10,924,866 B2
(45) Date of Patent: Feb. 16, 2021

(54) PIEZOELECTRIC SPEAKER

(71) Applicant: Nokia Technologies Oy, Espoo (FI)

(72) Inventors: Ian Davis, Dublin (IE); Akshat Agarwal, Meath (IE)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/287,338

(22) Filed: Feb. 27, 2019

(65) Prior Publication Data

US 2020/0275215 A1 Aug. 27, 2020

(51) Int. Cl.

| | |
|---|---|
| ***H04R 17/10*** | (2006.01) |
| ***H04R 3/04*** | (2006.01) |
| ***H04R 31/00*** | (2006.01) |

(52) U.S. Cl.

CPC ..... *H04R 17/10* (2013.01); *H04R 3/04* (2013.01); *H04R 31/006* (2013.01); *H04R 2499/11* (2013.01); *H04R 2499/15* (2013.01)

(58) Field of Classification Search

CPC ..... H04R 17/10; H04R 3/04; H04R 31/006; H04R 2499/15; H04R 2499/11

See application file for complete search history.

(56) References Cited

U.S. PATENT DOCUMENTS

| | | | | |
|---|---|---|---|---|
| 3,978,353 | A | 8/1976 | Kinoshita | |
| 4,352,961 | A | 10/1982 | Kumada et al. | |
| 6,427,017 | B1 | 7/2002 | Toki | |
| 6,865,785 | B2 * | 3/2005 | Ogura | H04R 17/00 29/25.35 |
| 7,863,804 | B2 * | 1/2011 | Tanaya | H03H 9/215 310/370 |
| 8,311,248 | B2 * | 11/2012 | Bai | H04R 31/00 381/190 |
| 8,385,578 | B2 * | 2/2013 | Onishi | H04R 17/00 381/390 |
| 10,327,052 | B2 * | 6/2019 | Arevalo Carreno | H04R 1/005 |
| 2004/0262555 | A1 * | 12/2004 | Eisengruber | H01L 41/0906 251/129.06 |
| 2005/0185809 | A1 * | 8/2005 | Bianchini | H04R 1/24 381/190 |
| 2009/0167109 | A1 | 7/2009 | Tomita et al. | |
| 2010/0096955 | A1 * | 4/2010 | Yamada | H01L 41/0475 310/370 |

(Continued)

FOREIGN PATENT DOCUMENTS

| | | | |
|---|---|---|---|
| CN | 202121776 | U | 1/2012 |
| JP | 2007275819 | A | 10/2007 |
| JP | 2014127749 | A | 7/2014 |

OTHER PUBLICATIONS

Mark Hughes "*How Piezoelectric Speakers Work*" Jun. 29, 2016. https://www.allaboutcircuits.com/technical-articles/how-piezoelectric-speakers-work/.

*Primary Examiner* — Oyesola C Ojo
(74) *Attorney, Agent, or Firm* — Harrington & Smith

(57) ABSTRACT

An apparatus including a first member; a first array of flexible actuators connected to the first member, where each of the flexible actuators includes a piezoelectric member and an extension on the piezoelectric member; and a first flexible membrane connected to the first array of flexible actuators. Each of the piezoelectric members is configured to be activated to move their respective extensions. Each of the extensions, when moved by their respective piezoelectric members, is configured to move the first flexible membrane.

28 Claims, 11 Drawing Sheets

(56) References Cited

U.S. PATENT DOCUMENTS

| | | | | |
|---|---|---|---|---|
| 2011/0135123 | A1 | 6/2011 | Kim et al. | |
| 2012/0203526 | A1 | 8/2012 | Bai et al. | |
| 2013/0077443 | A1* | 3/2013 | Onishi | G01S 7/521 367/99 |
| 2013/0083630 | A1* | 4/2013 | Onishi | H02N 2/001 367/99 |
| 2013/0272557 | A1* | 10/2013 | Ozcan | G06F 1/1637 381/333 |
| 2015/0345987 | A1* | 12/2015 | Hajati | B06B 1/0207 73/661 |
| 2017/0303048 | A1* | 10/2017 | Hooton | H04R 7/045 |
| 2018/0098139 | A1 | 4/2018 | Arevalo Carreno et al. | |
| 2020/0171542 | A1* | 6/2020 | Kho | B06B 1/0622 |

* cited by examiner

PIEZOELECTRIC SPEAKER

BACKGROUND

Technical Field

The example and non-limiting embodiments relate generally to an apparatus comprising a piezoelectric driver.

Brief Description of Prior Developments

Speakers which use a piezoelectric member are known.

SUMMARY

The following summary is merely intended to be an example. The summary is not intended to limit the scope of the claims.

In accordance with one aspect, an example embodiment is provided in an apparatus comprising a first member; a first array of flexible actuators connected to the first member, where each of the flexible actuators comprises a piezoelectric member and an extension on the piezoelectric member; and a first flexible membrane connected to the first array of flexible actuators, where each of the piezoelectric members is configured to be activated to move their respective extensions, and where each of the extensions, when moved by their respective piezoelectric members, is configured to move the first flexible membrane.

In accordance with another aspect, an example method is provided in a method comprising providing a plurality of first flexible actuators, where each of the first flexible actuators comprises a piezoelectric member and an extension on the piezoelectric member; connecting the plurality of first flexible actuators to a first member in a first array; and connecting the plurality of first flexible actuators to a first flexible membrane, where each of the piezoelectric members is configured to be activated to move their respective extensions relative to the first member, and where each of the extensions, when moved by their respective piezoelectric members, is configured to move the first flexible membrane.

In accordance with another aspect, an example method is provided in a method comprising providing a first voltage signal to a first piezoelectric member, where the first piezoelectric member is part of a first flexible actuator, where the first flexible actuator comprises a first extension on the first piezoelectric member; providing a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to at least one flexible membrane, and where the providing of the first and second voltage signals to the first and second piezoelectric members causes the first and second piezoelectric members to move which causes the first and second extensions to move the at least one flexible membrane.

In accordance with another aspect, an example embodiment is provided in an apparatus comprising at least one processor; and at least one non-transitory memory including computer program code, the at least one memory and the computer program code configured to, with the at least one processor, cause the apparatus to: provide a first voltage signal to a first piezoelectric member, where the first piezoelectric member is part of a first flexible actuator, where the first flexible actuator comprises a first extension on the first piezoelectric member; provide a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to at least one flexible membrane, and where the providing of the first and second voltage signals to the first and second piezoelectric members causes the first and second piezoelectric members to move which causes the first and second extensions to move the at least one flexible membrane.

In accordance with another aspect, an example embodiment is provided in a non-transitory program storage device readable by a machine, tangibly embodying a program of instructions executable by the machine for performing operations, the operations comprising: providing a first voltage signal to a first piezoelectric member, where the first piezoelectric member is part of a first flexible actuator, where the first flexible actuator comprises a first extension on the first piezoelectric member; providing a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to a at least one flexible membrane, and where the providing of the first and second voltage signals to the first and second piezoelectric members causes the first and second piezoelectric members to move which causes the first and second extensions to move the at least one flexible membrane.

In accordance with another aspect, an example embodiment is provided in an apparatus comprising: means for providing a first voltage signal to a first piezoelectric member, where the first piezoelectric member is part of a first flexible actuator, where the first flexible actuator comprises a first extension on the first piezoelectric member; means for providing a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to a at least one flexible membrane, and where the providing of the first and second voltage signals to the first and second piezoelectric members causes the first and second piezoelectric members to move which causes the first and second extensions to move the at least one flexible membrane.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
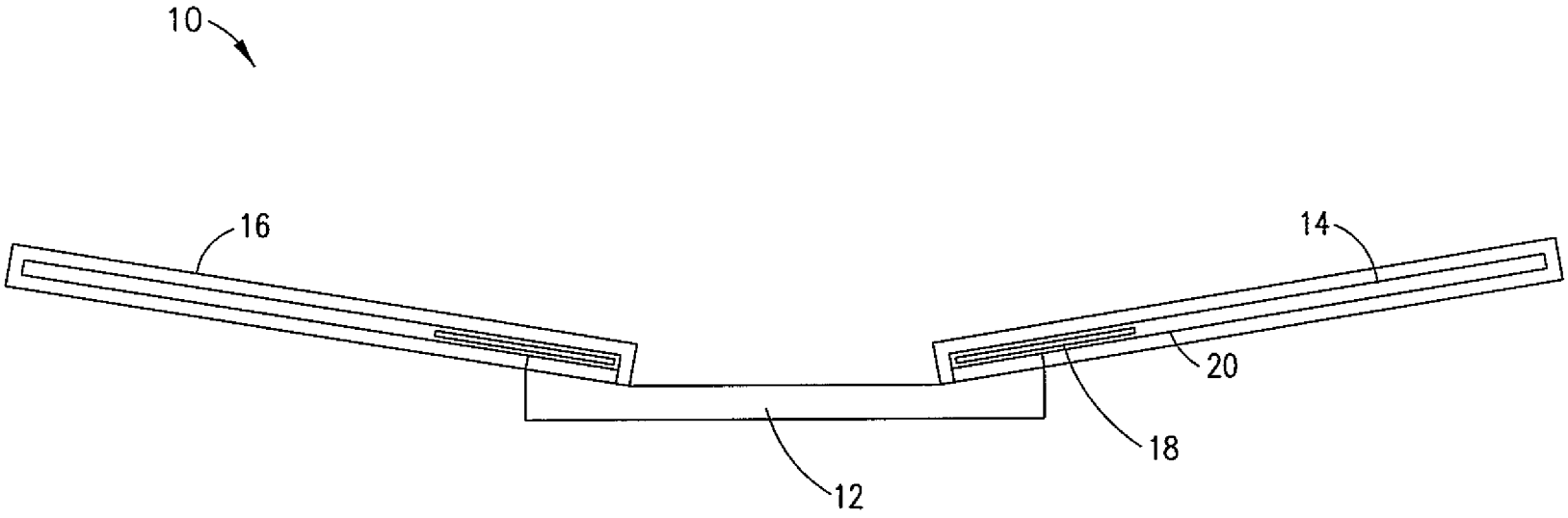
FIG. 1 is a schematic sectional view of an apparatus comprising features of an example embodiment.

Referring to FIG. 1, there is shown a schematic sectional view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
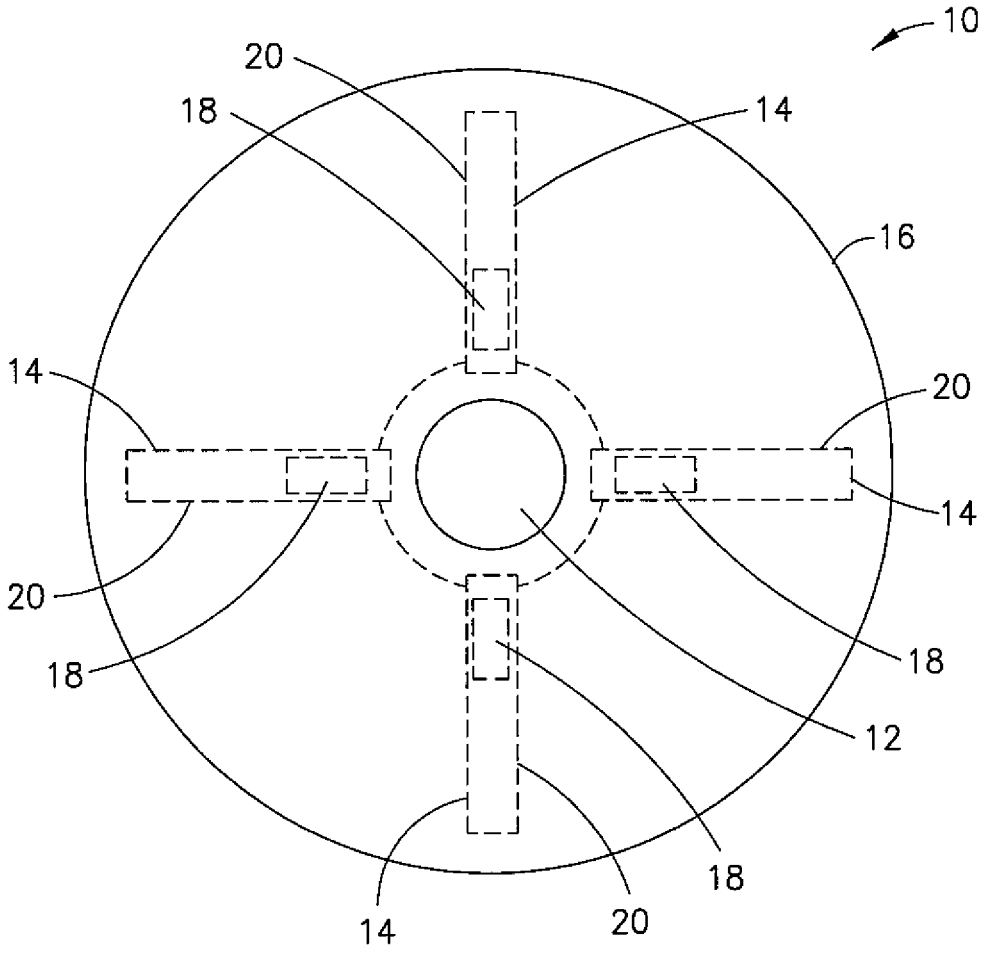
FIG. 2 is a top view of the apparatus shown in FIG. 1.

Referring also to FIG. 2, the apparatus 10 generally comprises a first member 12, an array of flexible actuators or drivers 14 and a flexible membrane 16. In this example the apparatus 10 is provided as a loudspeaker for an electronic device. The apparatus may be used for both sound reproduction in a broad frequency range as well as cooling, such as with electronics for example. Both the acoustic and cooling benefits are contained within a single multi-function device; minimizing the footprint of the apparatus 10.

The actuation mechanism for the apparatus 10 comprises the flexible actuators or drivers 14 which, in this example embodiment, each comprise a flexible extension 20 with a piezoelectric material or member 18 at least partially embedded within the extension 20. Although this example illustrates an embodiment with multiple actuators 14, in an alternate example an embodiment may be provided with merely one actuator. In the example shown, the combined assembly of the piezoelectric member 18 with the extension 20 forms a flexible beam. This flexible beam 14 is connected to, and extends from, the first member 12. The piezoelectric material 18 is configured to undergo a cyclical mechanical strain upon application of an alternating voltage. This, in turn, causes the flexible beam 14 to oscillate, with the amplitude of oscillation peaking when the actuation frequency of the piezoelectric material matches the natural frequency of the flexible beams 14. In this example, the flexible beams 14 are rigidly mounted at one end the first member 12 and extend outwardly from the first member 12 to be able to function as a form of oscillating cantilevered beam. The beams 14 may form at least part of a fan for moving air due to the oscillating nature of the beam movement. This may occupy very little space, such as a very small height. The piezoelectric material in such applications may be a ceramic such as Lead Zirconate Titanate (PZT), and the flexible beam may be made of a material such as FR-4. However, these are merely examples and should not be considered as limiting.

In the example embodiment shown, the array of flexible beams 14 are enveloped by the flexible membrane 16. A geometric shape of the array may be, for example, circular, a line, rectangular, oval, etc. However, in this example the array is generally circular. There is no restriction on the geometry, although the symmetry of a circular array is readily applicable and may exhibit the most conventional piston-like motion for a loudspeaker. When an alternating voltage is applied to one or more of the piezoelectric members 18, the corresponding flexible beam 14 oscillates which, in turn, results in oscillation of at least part of the flexible membrane 16, and perhaps entirely. This system may have a natural frequency based on the material properties of its various components. The oscillation amplitude of the flexible membrane 16 may be at its maximum when the piezoelectric material is actuated at this natural frequency. The oscillating membrane 16 is configured to displace surrounding air, and the pressure wave generated by this air displacement is able to propagate as sound.

In one example embodiment, where the apparatus 10 is used in a smart tablet device, the flexible beam 14 may be provided measuring 53 mm long, 10.3 mm wide and 0.7 mm high. Within the flexible beam, the piezoelectric material may measure 21.6 mm long, 3.7 mm wide and 0.18 mm high. Please note that these are merely examples and should not be considered as limiting. The encasement extension 20 of the piezoelectric material can be easily reduced in size to obtain a beam for use on a device smaller than a smart tablet. Further, piezoelectric material of a customized size can be obtained based on requirements for a particular application.

In the example embodiment shown in FIGS. 1-2, the first member 12 forms a stationary base for the apparatus. This stationary base 12 is provided at the center of the apparatus 10, and may be used to mount the apparatus to another component, such as a housing or frame of a portable electronic device. The flexible beams 14 are rigidly mounted to the first member 12. These beams 14 may then be enveloped in the flexible membrane 16. This example comprises four of the flexible beams 14. However, in alternate embodiments more or less than four beams could be provided. The flexible membrane 16 forms a cone of the loudspeaker in this example.

Figure 3:
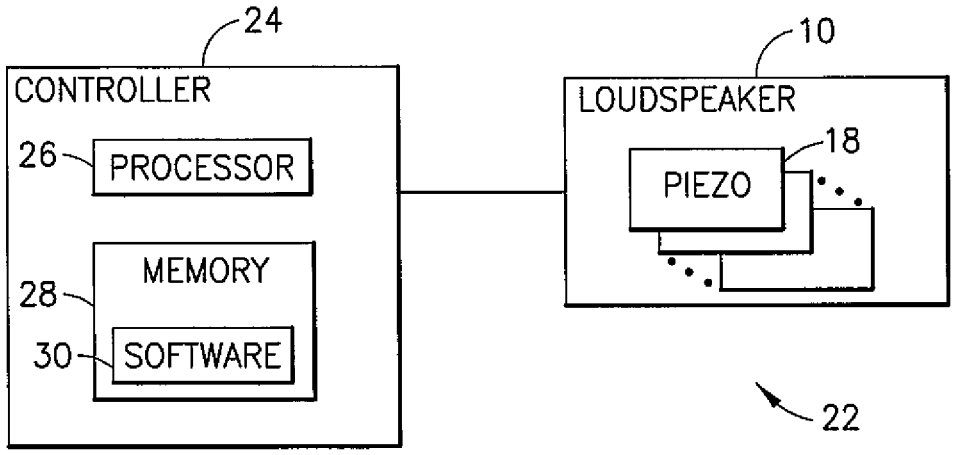
FIG. 3 is a diagram illustrating use of the apparatus of FIGS. 1-2 in a device.

Referring also to FIG. 3, an apparatus 22 is schematically illustrated comprising the loudspeaker 10 and a controller 24. In this example the controller 24 comprises at least one processor 26 and at least one memory 28 comprising software 30. The controller 24 is connected to the loudspeaker, such as with a voltage source, in order to control the delivery of voltage signals to the piezoelectric members 18. The voltage signals provided to the piezoelectric members 18 comprise audio signals in this example.

Figure 4:
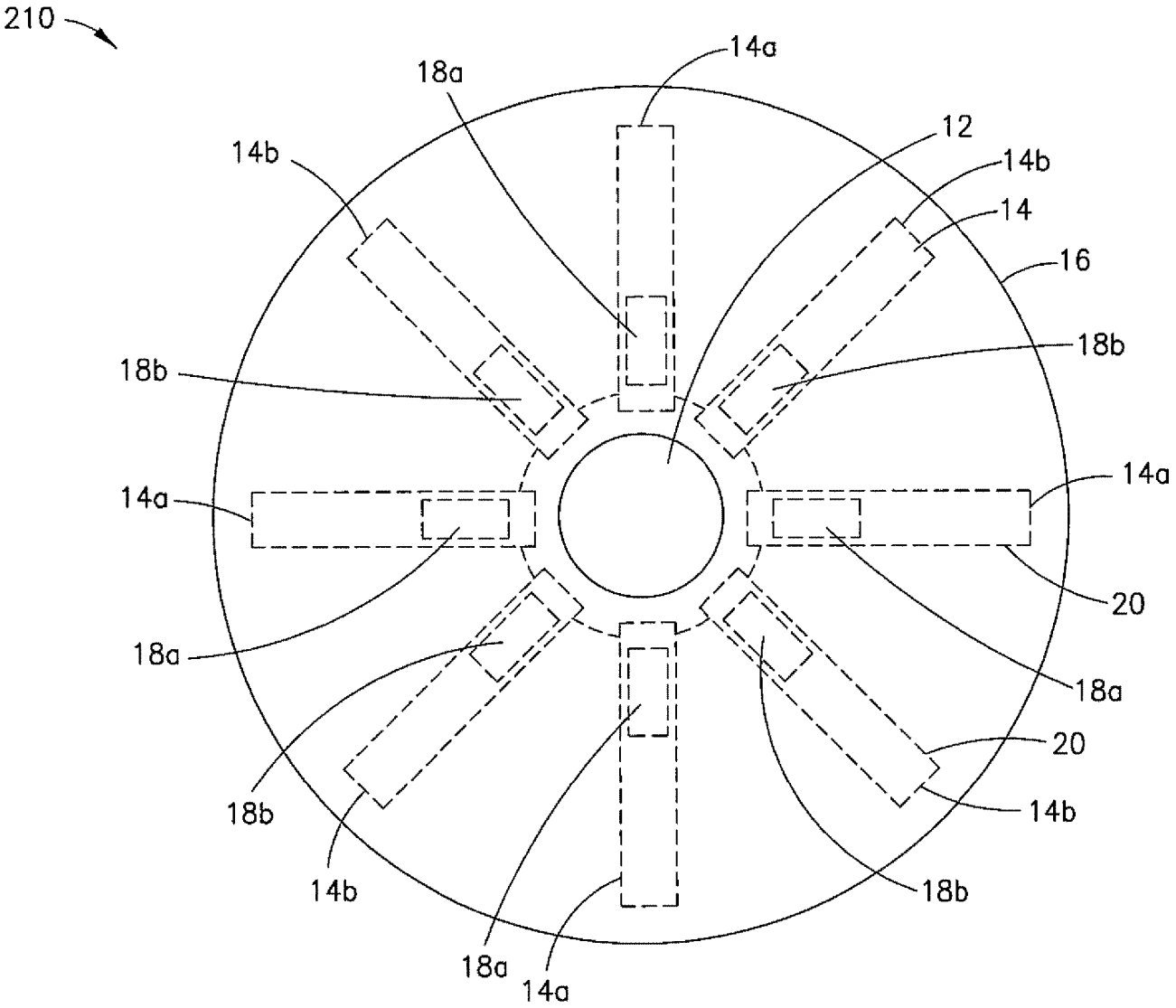
FIG. 4 is a top view similar to FIG. 2 showing an alternate example embodiment.

Referring also to FIG. 4, an alternate example embodiment is shown. In this example the apparatus 210 comprises the first member 12, an array of flexible drivers 14 and the flexible membrane 16. In this example the flexible drivers 14 comprise first flexible drivers 14*a* and different second flexible drivers 14*b*. The first flexible drivers 14*a* each comprise a first piezoelectric member 18*a* and an extension 20. The second flexible drivers 14*b* each comprise a second piezoelectric member 18*b* and an extension 20. In an alternate embodiment the extensions on the second flexible drivers 14*b* could be different from the extensions on the first flexible drivers 14*a*. The first piezoelectric member 18*a* are different from the second piezoelectric member 18*b*. In particular, in this example the differences between the first piezoelectric members 18*a* and the second piezoelectric members 18*b* allow the first flexible drivers 14*a* to have a different resonance frequency from the second flexible drivers 14*b*. Thus, in this example, a transducer may be provided with piezoelectric beams of multiple resonance frequencies within one membrane 16.

In the example shown in FIG. 4, the first flexible drivers 14*a* and the second flexible drivers 14*b* both extend outward radially from the first member 12. However, the first and second flexible drivers 14*a*, 14*b* are intermixed or intermingled with one another. The flexible drivers 14*a*, 14*b* are equal spaced from adjacent ones of the flexible drivers 14*a*, 14*b*. However, in alternate examples the spacing may not be equal and the intermixing may not be alternatingly uniform. Also, in an alternate example embodiment the shapes of the second flexible drivers 14*b* could be different from the shapes of the first flexible drivers 14*a* such as, for example, being longer, or wider, or thicker, or varying other suitable shapes including non-straight beams or non-cantilevered shapes. Thus, the term "beam" as used herein should not be considered to imply only straight. The beams may curve along their length or have varying cross sectional thicknesses.

A typical piezoelectric device (e.g. with a beam or cylindrical geometry) has a high-quality factor resonance. This means that the device has a very precise resonance frequency where the displacement is maximized. When the device is driven away from this frequency, the displacement for a given input voltage is greatly reduced. For this reason, piezoelectric materials that generate sound directly are constrained in what frequency sounds they can produce; usually limiting their application to buzzers or alarms.

This limitation may be overcome by placing piezoelectric ceramics with multiple resonance frequencies within a device. The device shown in FIG. 4 consists of piezoelectric ceramics with two different resonance frequencies. This provides the possibility of oscillating the apparatus 210 at multiple frequencies without the loss in displacement.

Figure 5:
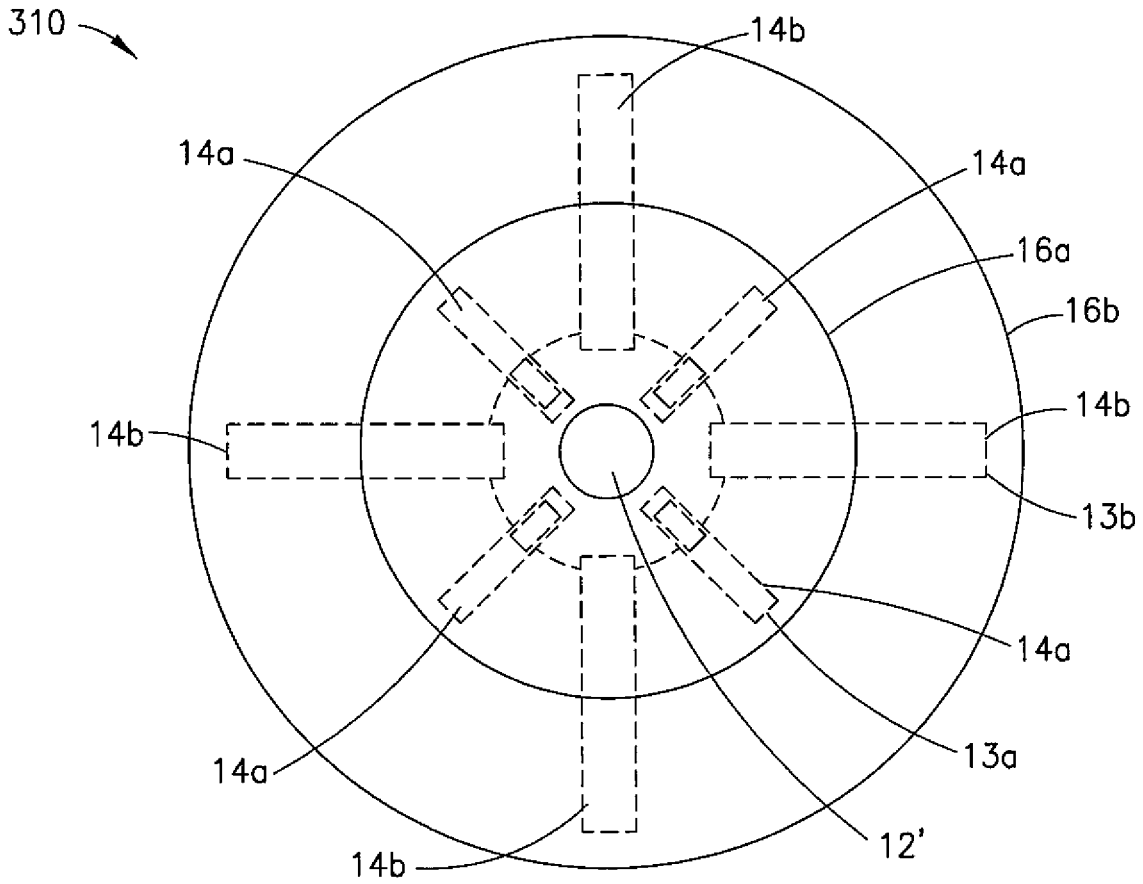
FIG. 5 is a top view similar to FIG. 2 showing an alternate example embodiment.
Figure 6:
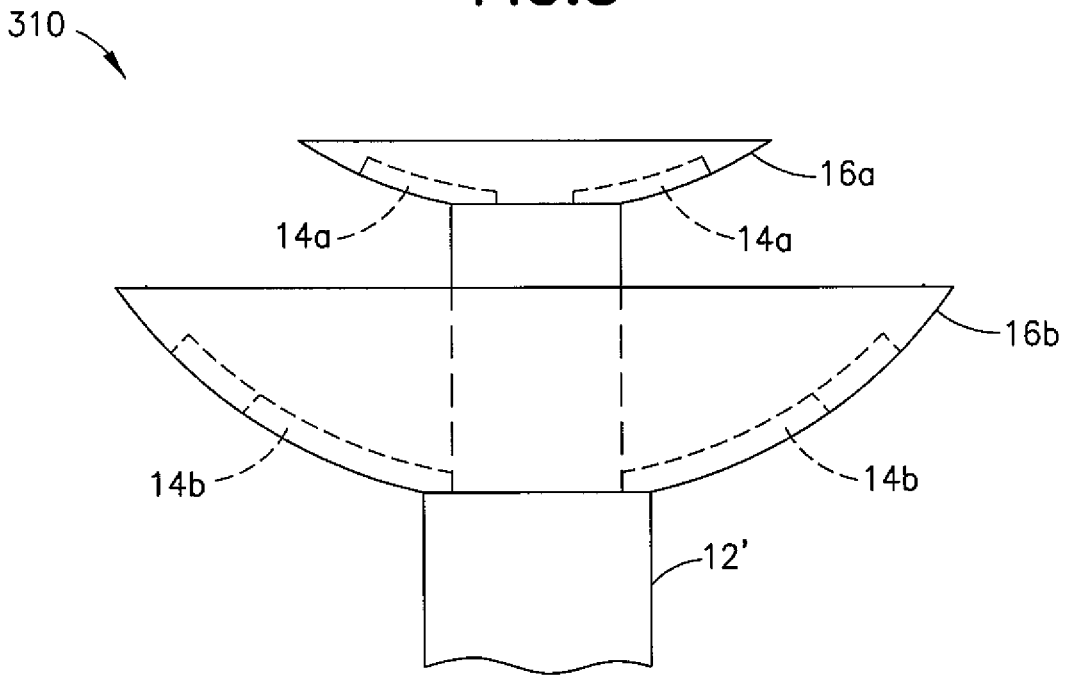
FIG. 6 is a side view of the apparatus shown in FIG. 5.
Figure 7B:
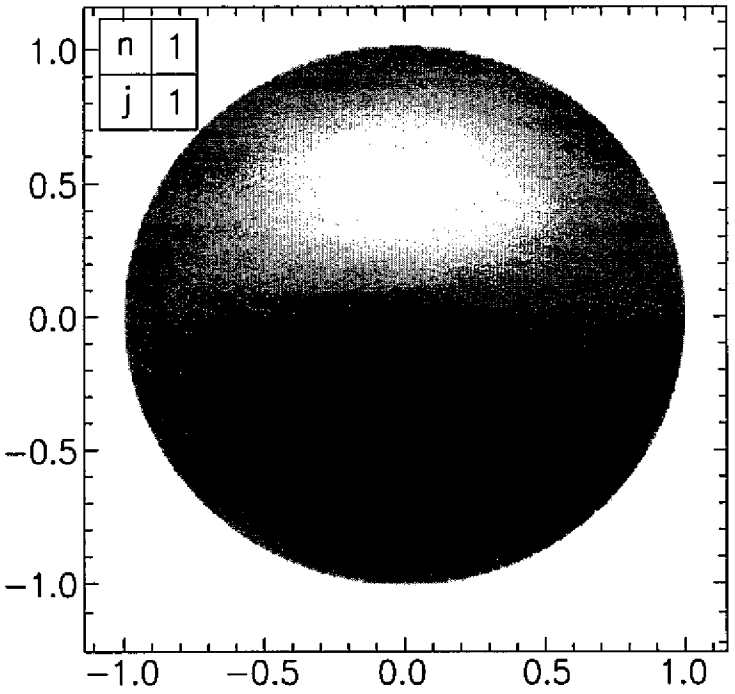
FIGS. 7A-7D are examples of a membrane excited by vibrations may trigger a specific resonance mode shape where displacement will greatly increase.
Figure 7A:
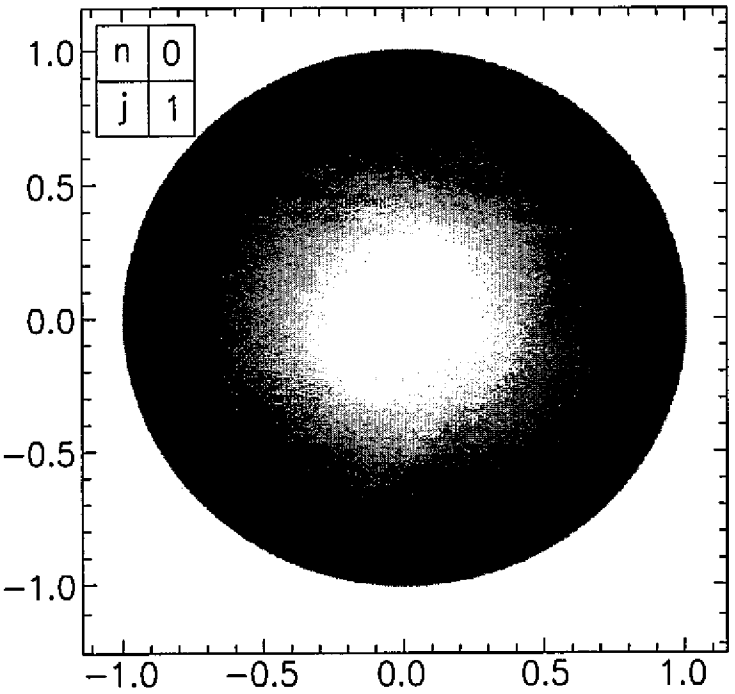
Figure 7D:
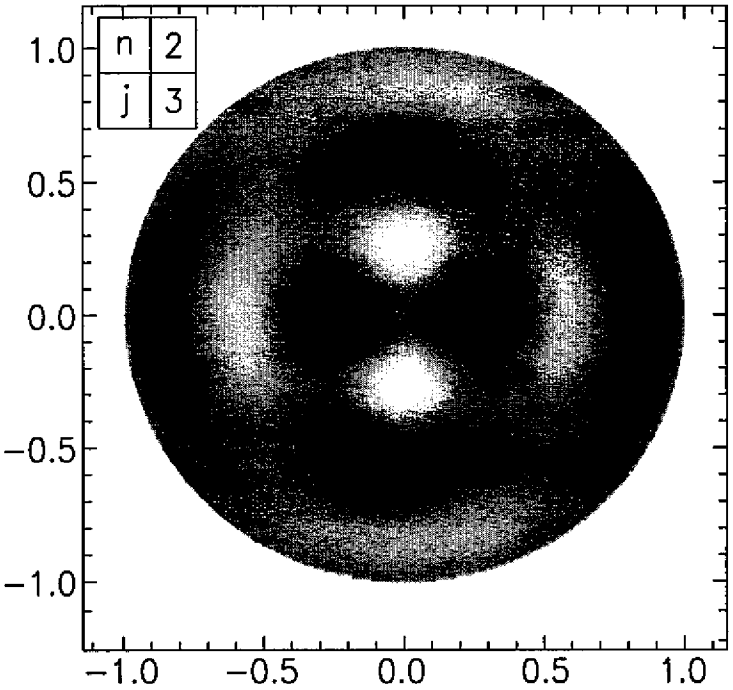
Figure 7C:
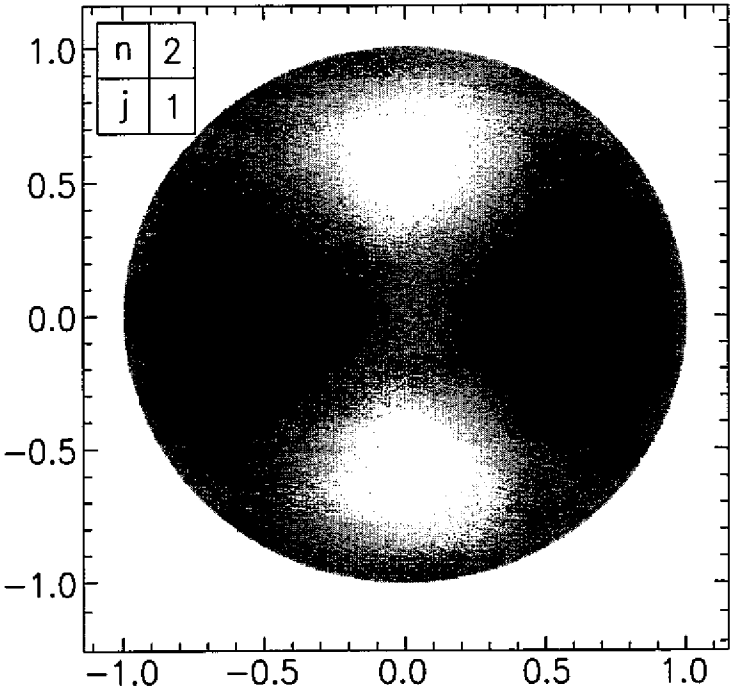

Referring also to FIGS. 5-6, an alternate example embodiment is shown of an apparatus 310 with piezoelectric beams of multiple resonance frequencies in separate membranes 16*a*, 16*b*. While the apparatus 210 shown in FIG. 4 has the piezoelectric ceramics of different resonance frequencies enveloped by a same membrane, in FIG. 5 they are placed within two separate membranes as shown. The two membranes 16*a*, 16*b* in this case are not directly connected to one another, and can be operated independently. The placement allows the possibility of an additional frequency with minimal change in the total volume occupied.

In the example embodiment shown in FIGS. 5-6, the apparatus 310 comprises a first member 12', a first array 13*a* of first flexible drivers 14*a*, a second array 13*b* of second flexible drivers 14*c*, a first flexible membrane 16*a*, and a second flexible membrane 16*b*. The first flexible drivers 14*a* and first flexible membrane 16*a* are connected to the first member 12' at a different height than the connection of the second flexible drivers 14*b* and second flexible membrane 16*b*. The first flexible membrane 16*a* could be seated wholly or partially inside the concave shape formed by the second flexible membrane 16*b*.

In specific example embodiments, some damping may be introduced by the diaphragm, a spider and/or a frame which will change the quality factor of the resonance. However, once the frequency response of the device is known, the frequency response of the audio voltage signal may be filtered to compensate to ensure a flat output frequency response.

With features as described herein, when compared with a conventional electromagnetic acoustic driver:

- The apparatus does not rely on magnets for diaphragm displacement, making it suitable in applications where a magnetic field is undesirable;
- By removing a need for a fixed magnet from the speaker base, the height of the apparatus and its mass may be reduced;
- The arrays of piezoelectric beams can be used to target specific resonant mode shapes in the membrane. For example, if the frequency of the excitation signal is close to excitation of the first azimuthal mode of the membrane, the relative phase of the signals to each piezoelectric beam can be adjusted to maximize the membrane displacement (as illustrated by FIGS. 7A-7D);
- The piezoelectric beams may have extremely high reliability and be applied in scenarios where an electromagnetic speaker would be damaged (such as underwater for example).

FIGS. 7A-7D illustrate that, at specific frequencies, a membrane excited by vibrations may trigger a specific resonance mode shape where displacement will greatly increase. A range of these mode shapes are shown for a circular membrane. See also, for example, https://mathematica.stackexchange.com/questions/56698/circular-membrane-vibration-simulation.

Some of the features with the piezospeaker design have been demonstrated using numerical simulations of a simplified version of a possible piezospeaker design. This investigation has been performed using COMSOL Multiphysics to capture the dynamics of the piezoelectric beams which act as the sources of vibration, the flexible membrane and how this vibration couple to sound transmission in the surrounding air. The simulation included five piezo beams, equi-azimuthally spaced around the underside of a circular flexible polymer membrane (vinyl), and each blade made a 10 mm×5 mm contact with the membrane. The membrane was 60 mm in diameter with 1 mm thickness. The frequency of excitation as well as the phase of the vibration between each source was modified in the simulation. A hemispherical domain of air around the device was analysed to investigate the directivity of the piezospeaker at specific frequencies, as well as the output power of the speaker versus frequency. Note that this was a simplified implementation illustrative of a possible speaker design and does not account for effects such as ringing that can be mitigated with more sophisticated suspension designs; such as the spiders used in traditional electromagnetic drivers.

Figure 8:
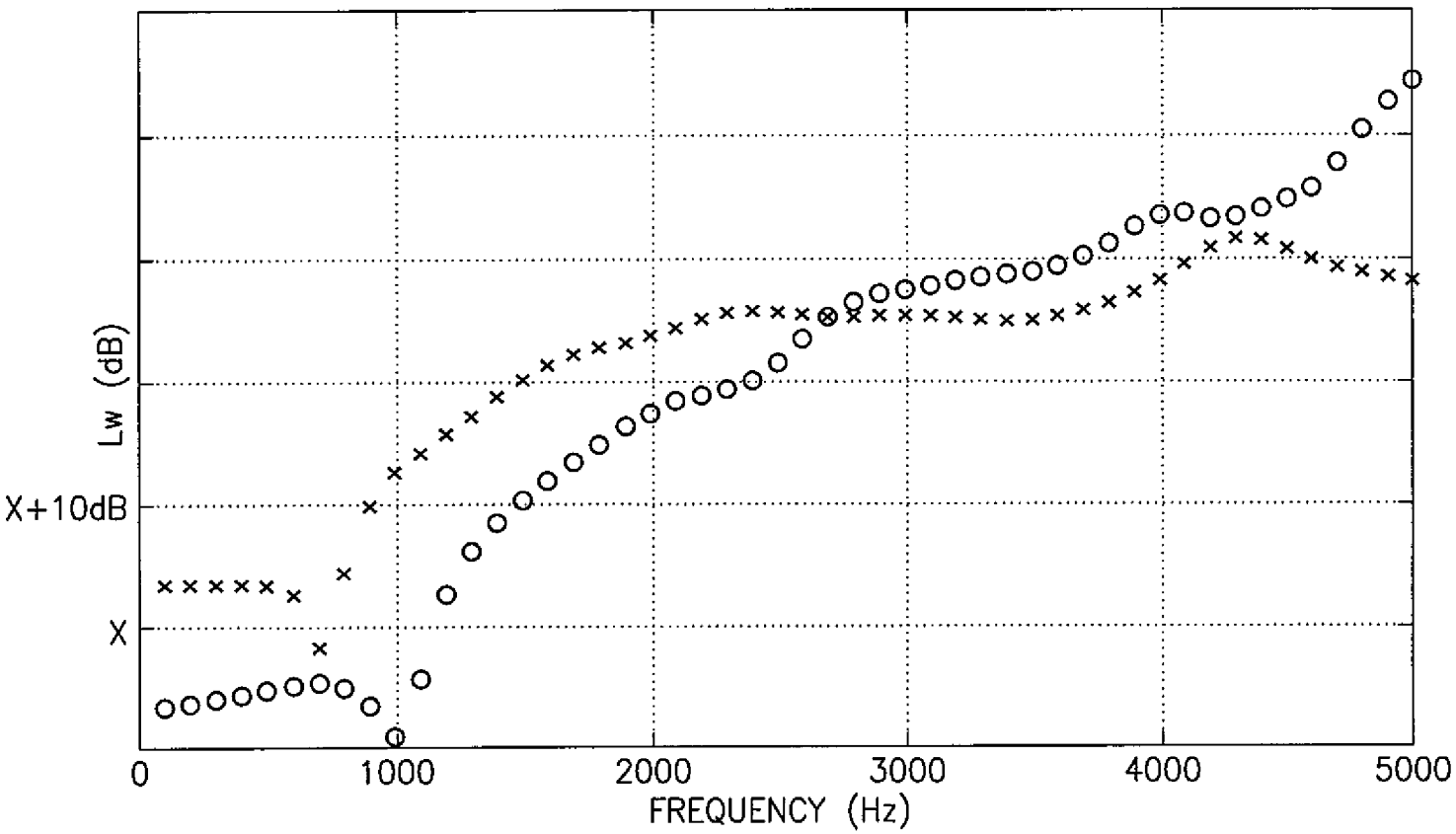
FIG. 8 is a diagram illustrating sound power output from a piezospeaker excited in two different modes.

FIG. 8 is a diagram illustrating sound power output from a piezospeaker excited in mode A ("x") and mode B ("o"). The advantage of using multiple piezoelectric beams is demonstrated in the results. FIG. 8 demonstrates the frequency response of the piezospeaker under two potential operating modes:

- Mode A, when each blade is excited with an identical voltage signal (zero phase difference);
- Mode B, where each blade (m) receives a signal with a phase given by $$\phi_m = \frac{m2\pi}{5}$$

Both frequency response curves exhibit poor sound radiation at certain frequencies. However, having the ability to control the phase between the piezoelectric sources allows the output of the piezospeaker to be boosted. For instance, at low frequencies the mode A is more effective, but at around 2800 Hz there is a crossover where the mode B will be more efficient. By providing a wider range of possible operating modes, the piezospeaker has advantages in flexibility over conventional speaker designs.

Figure 9B:
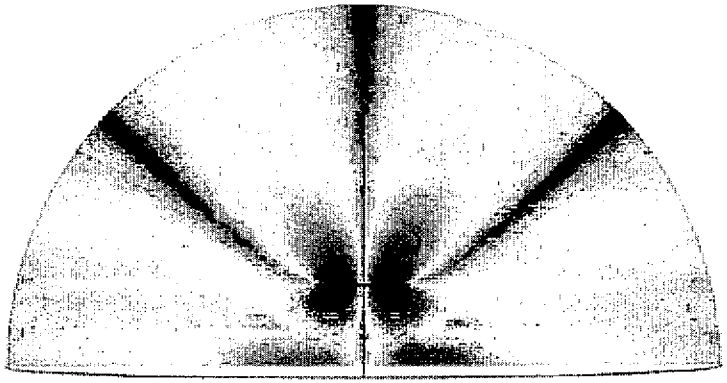
FIG. 9B is side view of acoustic pressure around a piezospeaker at 5 kHz operating in a second one of the modes shown in FIG. 8.
Figure 9A:
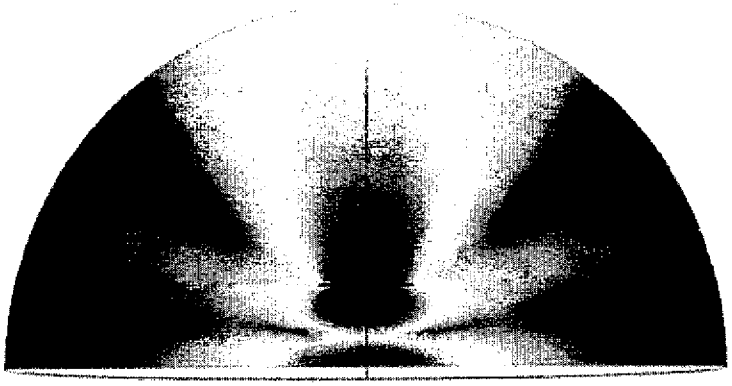
FIG. 9A is side view of acoustic pressure around a piezospeaker at 5 kHz operating in a first one of the modes shown in FIG. 8.

As well as controlling the frequency response of the piezospeaker, the ability to adjust the phase between sources also gives control over the speaker directivity at higher frequencies. FIG. 9A is side view of acoustic pressure around a piezospeaker at 5 kHz operating in mode A. FIG. 9B is side view of acoustic pressure around a piezospeaker at 5 kHz operating in mode B. FIGS. 9A and 9B show how adjusting the phase between the piezoelectric beams may be used to change the directivity; with a marked decrease in the sound pressure radiated on-axis from the piezospeaker device.

Figure 10:
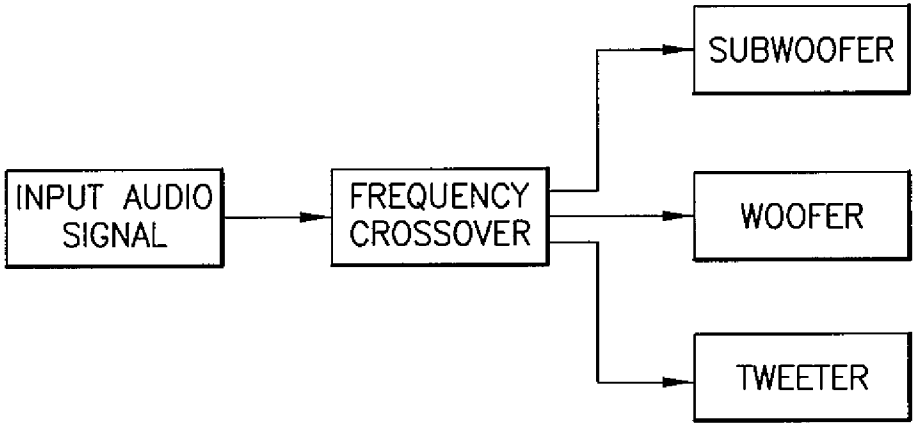
FIG.10 PRIOR ART
FIG. 10 is a diagram illustrating a conventional sound reproduction system.

An example of a process flow showing how a conventional sound reproduction system is implemented is shown in FIG. 10. The process flow of a typical broad frequency sound reproduction system is shown, where an input audio is split into frequency bands for one or multiple acoustic drivers. This process flow could be replicated for multiple input channels for multichannel audio (such as for stereo for example).

Figure 11:
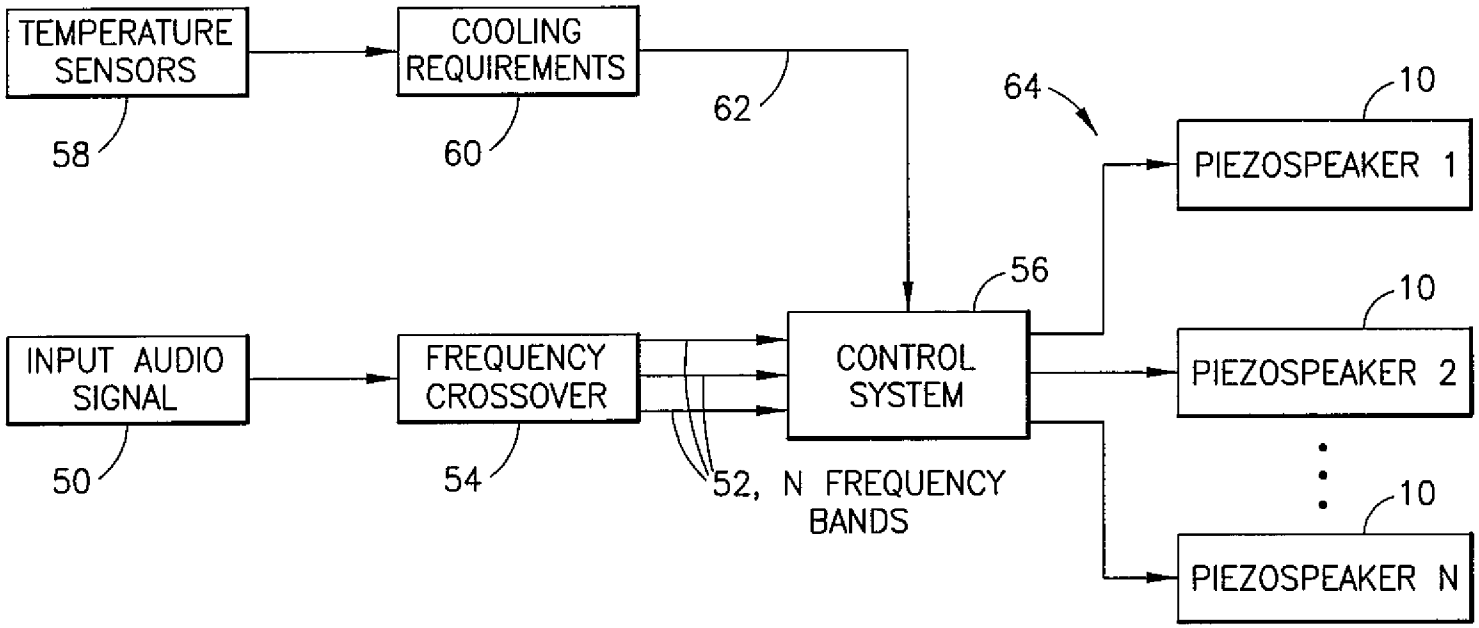
FIG. 11 is a diagram illustrating one example of a system comprising features as described herein capable of sound reproduction and cooling.

An example of a process flow with features as described herein is shown in FIG. 11. With features as described herein, the input sound signal may be split into many frequency bands, such as depending on the number of concentric piezospeakers for example. In addition, one or more of the piezospeakers may be used to provide additional cooling inside the device, such as based on a monitored temperature(s) of a device or component inside a device. In this process flow, the total available output of sound and airflow may be balanced depending on the device temperatures as well as the volume of the sound output that is required by the user. FIG. 11 illustrates an example process flow of the piezospeaker array, where the concentric array of speakers may provide both cooling and sound reproduction functions. Similar to FIG. 10, multichannel audio could also be represented with multiple input audio signal/crossover elements. In this example, an input audio signal 50 may be separated into frequency bands 52 by a crossover 54. This frequency bands 52 may be provided to a control system 56. An apparatus may comprises one or more temperature sensors 58. The temperature sensor(s) 58 may provide output(s) and references to cooling requirements 60, provide signals 62 to the control system 56. The control system may then provide signals 64 to one or more piezospeakers 10 (or 210, 310, etc.) to drive the piezos 18.

Figure 12:
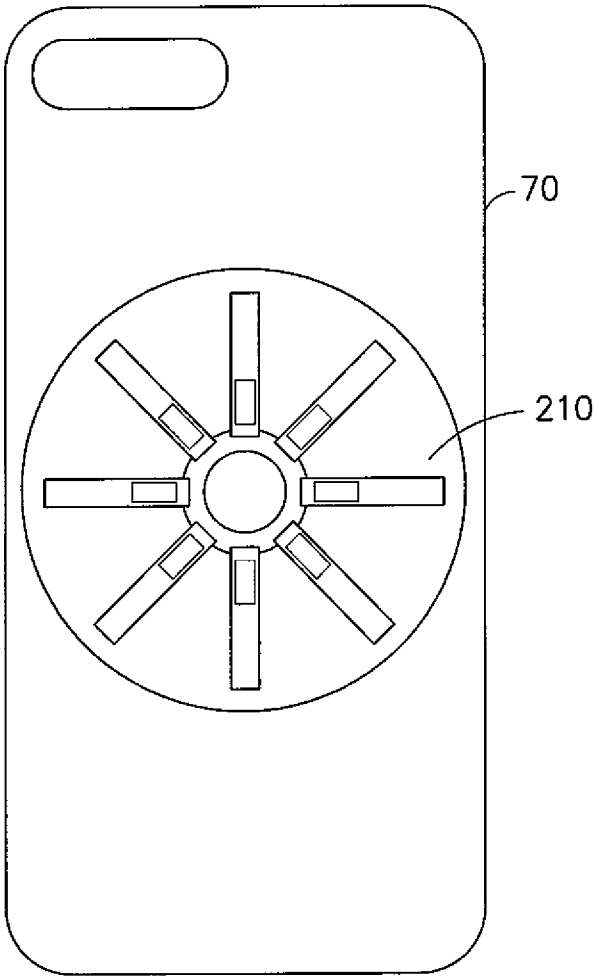
FIG. 12 is a schematic illustration of an apparatus as described herein in use in a mobile phone.

Referring also to FIG. 12, an example embodiment comprising features as described herein is shown in a device 70 as a woofer or mid-frequency speaker 210. In this example the device 70 is a mobile phone. Due to the low profile or thickness of the speaker 210, it can be encased within a typical mobile phone with minimal change in the original dimensions of the mobile phone. This speaker can then function along with existing speakers within the mobile phone to provide audio output over a wider range of frequencies.

Figure 13:
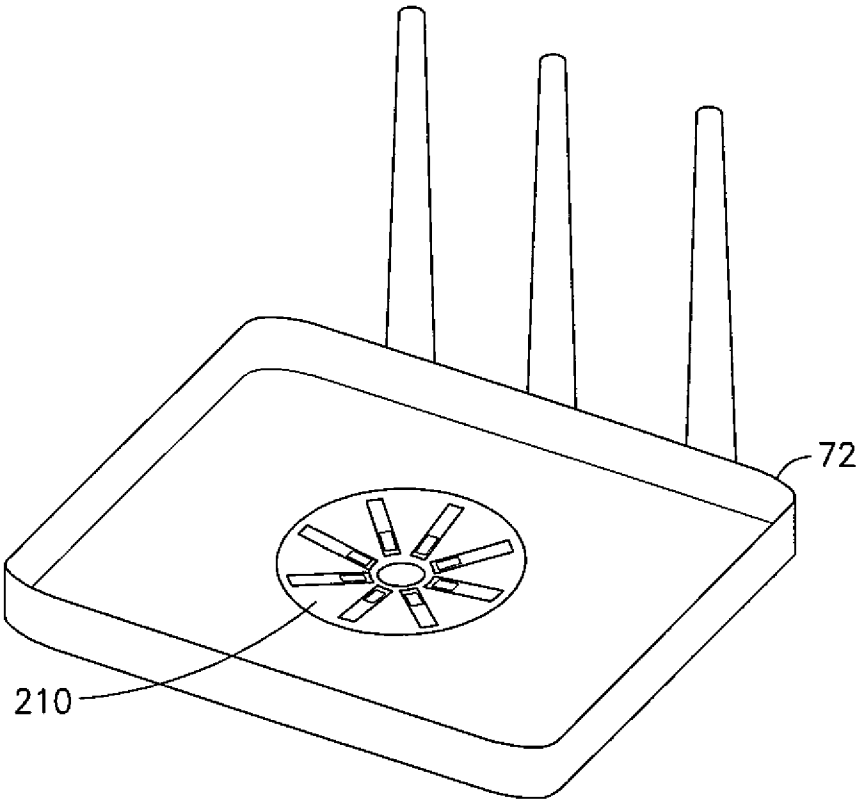
FIG. 13 is a schematic illustration of an apparatus as described herein in use in a wireless communication node.

Another example embodiment is shown in FIG. 13. In this example the speaker 210 is shown within a wireless telecommunication product 72. In this example the wireless telecommunication product 72 is a router for wireless internet coverage, such as within a home or office setting for example. The product 72 is shown without a top cover, and other electronic components within the product are not shown merely for clarity. With the advent of smart homes and offices, in which several sensing and control functions within the setting are connected wirelessly, such a router may fulfil a secondary role of a security system. In such a case, the device 72 may act as an intruder alarm; oscillating the speaker 210 at the resonance frequency to sound an alarm when the system detects an intruder. Further, when not sounding an alarm, the device may act as an air mover for cooling purposes. In this case, it may oscillate off-resonance; creating air flow, but minimal sound.

Figure 14:
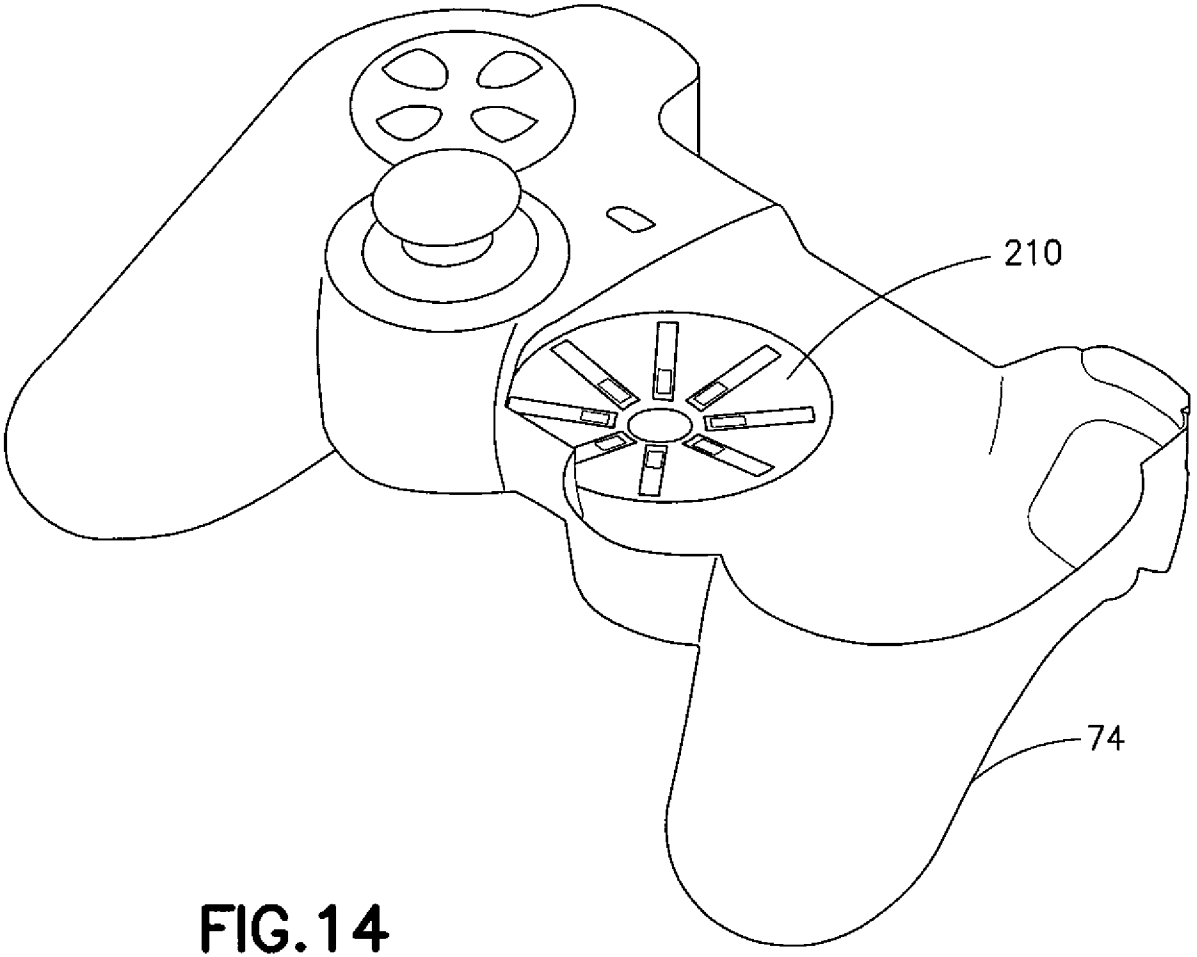
FIG. 14 is a schematic illustration of an apparatus as described herein in use in a handheld gaming controller.

A further example embodiment is shown in FIG. 14. In this example a device 74 having the speaker 210 therein. In this example the device 74 is a handheld controller for a games console. As games consoles have developed, their controllers have become increasingly complex systems. A conventional controller consists of components which provide haptic and audio feedback based on user input. In this case, the embedded apparatus 210 may provide audio and haptic feedback by oscillating at the various appropriate frequencies. In addition, the apparatus 210 may act as an air mover thereby cooling electronic components within the controller 74. When acting as an air mover, the forced air flow may also be vented to the user's hands for cooling for additional comfort. This example illustrates a multi-functional component to provide audio, haptic feedback and an air mover for cooling.

Piezoelectric materials, which convert electrical energy to mechanical strain or vice versa, are commonly used as sound generating devices. By cyclically straining the piezoelectric material using an input voltage signal, the material will radiate sound. An advantage to piezoelectric speakers is their reliability, low cost and small form factor. In conventional devices their main disadvantage is their limited frequency response and sound quality.

Reproduction of low-frequency sound using loudspeakers typically requires large driver units mounted to resonant cavities to boost low frequency performance. In many products such as mobile devices, laptops and tablets, the available volume is limited. This in turn limits the ability of these devices to reproduce low frequency sounds such as bass in music. However, with features as described herein a system may be presented which utilises piezoelectric beams to drive the motion of a membrane. This allows low frequency sound to be generated with a low profile; which makes the invention particularly well suited to applications where space is limited.

In a typical high-fidelity system of sound production, the goal is to generate sound across the full range of human hearing with a high efficiency and a flat/linear frequency response. This frequency range extends from around 20 Hz to around 20,000 Hz. This cannot typically be achieved using a single driver unit. For this reason, common speaker designs contain multiple electromagnetic drivers (such as woofers and tweeters) optimized for specific frequency ranges. A digital or analog crossover splits the incoming signal into these frequency ranges which are then relayed as inputs to each driver. In small devices such as mobile phones, space constraints generally limit the sound production system to a single type of driver which must deliver sound in a wide frequency range. At low frequencies, drivers such as woofers and subwoofers must move a larger volume of air in order to generate sound. This is achieved in several ways; by increasing the driver diameter, by increasing the peak-to-peak driver displacement using a stronger magnet, and/or by attaching the back of the driver to an enclosure with a low resonance frequency. All the above listed state-of-the-art solutions add volume and mass to the system, and the volume requirements increase as lower frequency sounds are required. However, with use of features as described herein, a piezoelectric driven apparatus may be provided with a very low height/profile but which can provide a good woofers and subwoofers functionality; such as for hand-held electronics for example.

An example embodiment may be provided in an apparatus comprising a first member; a first array of flexible actuators connected to the first member, where each of the flexible actuators comprises a piezoelectric member and an extension on the piezoelectric member; and a first flexible membrane connected to the first array of flexible actuators, where each of the piezoelectric members is configured to be activated to move their respective extensions, and where each of the extensions, when moved by their respective piezoelectric members, is configured to move the first flexible membrane.

Each of the flexible actuators may comprise a flexible beam formed by their respective piezoelectric member and extension. Each of the flexible actuators may extend outward from the first member. Each of the flexible actuators may extend radially from the first member in a general cantilever fashion. Each of the flexible actuators may comprise piezoelectric material embedded in the their respective extension. The first array of flexible actuators comprises at least four of the flexible actuators rigidly mounted to the first member. The first flexible membrane may form a flexible cone about the first member. The flexible actuators may comprise at least a first flexible actuator and a different second flexible actuator. The piezoelectric members of the first and second flexible actuators may comprise different resonance frequencies. The first and second flexible actuators may be arranged in an intermixed pattern in the first array. The first array of flexible actuators may comprise the flexible actuators being arranged equi-azimuthally spaced about the first member. The apparatus may further comprise a second array of flexible actuators connected to the first member. The apparatus may further comprise a separate second flexible membrane connected to the second array of flexible actuators, where the second flexible membrane is spaced from the first flexible membrane. The first and second flexible membranes may be arranged in a stacked configuration relative to each other. The second membrane may be larger than the first membrane. The first member may be located in a housing of at least one of: a handheld electronic device, a mobile phone, a computer tablet, a computer laptop, a wireless communication device, or a handheld game controller for a game console. The apparatus may further comprise a controller configured to cause first voltage signals to be sent to first ones of the piezoelectric members. The controller may be configured to cause different second voltage signals to be sent to second ones of the piezoelectric members at a same time that the controller causes the first voltage signals to be sent to the first piezoelectric members. The controller may be configured to cause adjustment of phase of the voltage signals to adjust directivity of sound from the apparatus. The controller may be configured to cause the first voltage signals to be sent to the first array of flexible actuators to cause activation of the piezoelectric members in a first mode or a second mode, where the first mode comprises voltage signals without a phase difference and the second mode comprises voltage signals with a phase difference. The controller may be configured, with use of the first and second modes, to control a frequency response of the apparatus.

An example method may be provided comprising: providing a plurality of first flexible actuators, where each of the first flexible actuators comprises a piezoelectric member and an extension on the piezoelectric member; connecting the plurality of first flexible actuators to a first member in a first array; and connecting the plurality of first flexible actuators to a first flexible membrane, where each of the piezoelectric members is configured to be activated to move their respective extensions relative to the first member, and where each of the extensions, when moved by their respective piezoelectric members, is configured to move the first flexible membrane.

The first flexible actuators each comprise a flexible beam formed by their respective piezoelectric member and extension. The first array may comprise each of the first flexible actuators extending outward from the first member. The connecting of the plurality of first flexible actuators to the first member may comprise each of the flexible actuators extend radially from the first member in a general cantilever fashion. The providing of the plurality of first flexible actuators may comprise the each of the first flexible actuators comprising piezoelectric material embedded in the their respective extension. The connecting of the plurality of first flexible actuators to the first member in the first array may comprise a rigid mount of at least four of the first flexible actuators to the first member. The connecting of the plurality of first flexible actuators to the first flexible membrane may comprise forming the first flexible membrane onto the first flexible actuators. The method may further comprise: providing a plurality of second flexible actuators, where each of the second flexible actuators comprises a piezoelectric member and an extension on the piezoelectric member; connecting the plurality of second flexible actuators to the first member in a second array; and connecting the plurality of second flexible actuators to the first flexible membrane. The providing of the plurality of first flexible actuators and the providing of the plurality of second flexible actuators may comprise providing the first and second flexible actuators with different resonance frequencies. The connecting of the plurality of first flexible actuators to the first member in a first array and the connecting of the plurality of second flexible actuators to the first member in the second array may comprise the first and second flexible actuators being arranged in an intermixed pattern. The connecting of the plurality of first flexible actuators to the first member in the first array may comprise the flexible actuators being arranged equi-azimuthally spaced about the first member. The method may further comprise connecting a second array of flexible actuators to the first member. The method may further comprise connecting a separate second flexible membrane to the second array of flexible actuators, where the second flexible membrane is spaced from the first flexible membrane. The first and second flexible membranes may be arranged in a stacked configuration relative to each other. The second membrane may be larger than the first membrane.

An example method may be provided comprising: providing a first voltage signal to a first piezoelectric member, where the first piezoelectric member is part of a first flexible actuator, where the first flexible actuator comprises a first extension on the first piezoelectric member; providing a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to at least one flexible membrane, and where the providing of the first and second voltage signals to the first and second piezoelectric members causes the first and second piezoelectric members to move which causes the first and second extensions to move the at least one flexible membrane.

The first and second voltage signals may be provided to the first and second piezoelectric members at a same time. The second voltage signals may be provided to the second piezoelectric members after the first voltage signals are provided to the first piezoelectric members by a crossover. The method may further comprise causing adjustment of phase of the voltage signals to adjust directivity of sound from the at least one flexible membrane. The method may further comprise causing the first voltage signals to be provided to the first flexible actuators to cause activation of the first piezoelectric members in a first mode, and causing the second voltage signals to be provided to the second flexible actuators to cause activation of the second piezoelectric members in a second mode, where the first mode comprises voltage signals without a phase difference and the second mode comprises voltage signals with a phase difference. The method may further comprise using the first and second modes to control a frequency response of the at least one flexible membrane. The at least one flexible membrane may comprise a first flexible membrane having the first flexible actuators connected thereto and a second flexible membrane having the second flexible actuators connected thereto, where the first and second flexible membranes are separate from each other.

An example embodiment may be provided in an apparatus comprising: at least one processor; and at least one non-transitory memory including computer program code, the at least one memory and the computer program code configured to, with the at least one processor, cause the apparatus to: provide a first voltage signal to a first piezoelectric member, where the first piezoelectric member is part of a first flexible actuator, where the first flexible actuator comprises a first extension on the first piezoelectric member; provide a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to at least one flexible membrane, and where the providing of the first and second voltage signals to the first and second piezoelectric members causes the first and second piezoelectric members to move which causes the first and second extensions to move the at least one flexible membrane.

The at least one memory and the computer program code may be configured to, with the at least one processor, cause the apparatus to: provide the first and second voltage signals to the first and second piezoelectric members at a same time. The at least one memory and the computer program code may be configured to, with the at least one processor, cause the apparatus to: provide the second voltage signals to the second piezoelectric members after the first voltage signals are provided to the first piezoelectric members by a crossover. The at least one memory and the computer program code may be configured to, with the at least one processor, cause the apparatus to: cause adjustment of phase of the voltage signals to adjust directivity of sound from the at least one flexible membrane. The at least one memory and the computer program code, may be configured to, with the at least one processor, cause the apparatus to: cause the first voltage signals to be provided to the first flexible actuators to cause activation of the first piezoelectric members in a first mode, and cause the second voltage signals to be provided to the second flexible actuators to cause activation of the second piezoelectric members in a second mode, where the first mode comprises voltage signals without a phase difference and the second mode comprises voltage signals with a phase difference. The at least one memory and the computer program code may be configured to, with the at least one processor, cause the apparatus to: use the first and second modes to control a frequency response of the at least one flexible membrane. The at least one flexible membrane may comprise a first flexible membrane having the first flexible actuators connected thereto and a second flexible membrane having the second flexible actuators connected thereto, where the first and second flexible membranes are separate from each other.

An example embodiment may be provided in a non-transitory program storage device readable by a machine, tangibly embodying a program of instructions executable by the machine for performing operations, the operations comprising: providing a first voltage signal to a first piezoelectric member, where the first piezoelectric member is part of a first flexible actuator, where the first flexible actuator comprises a first extension on the first piezoelectric member; providing a second voltage signal to a second piezoelectric member, where the second piezoelectric member is part of a second flexible actuator, where the second flexible actuator comprises a second extension on the second piezoelectric member; where the first and second flexible actuators are connected by the first and second extensions to a at least one flexible membrane, and where the providing of the first and second voltage signals to the first and second piezoelectric members causes the first and second piezoelectric members to move which causes the first and second extensions to move the at least one flexible membrane.

The operations may comprise providing the first and second voltage signals to the first and second piezoelectric members at a same time. The operations may comprise providing the second voltage signals to the second piezoelectric members after the first voltage signals are provided to the first piezoelectric members by a crossover. The operations may comprise causing adjustment of phase of the voltage signals to adjust directivity of sound from the at least one flexible membrane. The operations may comprise causing the first voltage signals to be provided to the first flexible actuators to cause activation of the first piezoelectric members in a first mode, and cause the second voltage signals to be provided to the second flexible actuators to cause activation of the second piezoelectric members in a second mode, where the first mode comprises voltage signals without a phase difference and the second mode comprises voltage signals with a phase difference. The operations may comprise using the first and second modes to control a frequency response of the at least one flexible membrane. The at least one flexible membrane may comprise a first flexible membrane having the first flexible actuators connected thereto and a second flexible membrane having the second flexible actuators connected thereto, where the first and second flexible membranes are separate from each other.

An example embodiment may be provided in an apparatus comprising means for providing a first voltage signal to a first piezoelectric member, where the first piezoelectric member is part of a first flexible actuator, where the first flexible actuator comprises a first extension on the first piezoelectric member; means for providing a second voltage signal to a second piezoelectric member, where the second piezoelectric member is part of a second flexible actuator, where the second flexible actuator comprises a second extension on the second piezoelectric member, where the first and second flexible actuators are connected by the first and second extensions to a at least one flexible membrane, and where the providing of the first and second voltage signals to the first and second piezoelectric members causes the first and second piezoelectric members to move which causes the first and second extensions to move the at least one flexible membrane.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a first member;

a first array of flexible actuators connected to the first member, where the flexible actuators of the first array respectively comprise a piezoelectric member and an extension connected to the piezoelectric member at a connection; and a first flexible membrane connected to the first array of flexible actuators, where the first flexible membrane is formed onto, of respective flexible actuators of the first array, the piezoelectric member, the extension, and the connection between the piezoelectric member and the extension, where the respective piezoelectric members are configured to be activated to move their respective extensions, and where the extensions, when moved with their respective piezoelectric members, are respectively configured to move the first flexible membrane.

2. An apparatus as in claim 1 where the flexible actuators of the first array respectively comprise a flexible beam formed with their respective piezoelectric member and extension.

3. An apparatus as in claim 1 where the flexible actuators of the first array extend outward from the first member.

4. An apparatus as in claim 1 where the flexible actuators of the first array extend radially from the first member in a general cantilever fashion.

5. An apparatus as in claim 1 where the flexible actuators of the first array respectively comprise piezoelectric material embedded in the respective extension, wherein the respective extension:

comprises a blade, or at least partially encases a corresponding piezoelectric member.

6. An apparatus as in claim 1 where the first array of flexible actuators comprises at least four of the flexible actuators rigidly mounted to the first member.

7. An apparatus as in claim 1 where the first flexible membrane forms a flexible cone about the first member, where the first flexible membrane at least partially forms the connection between the piezoelectric member and the extension.

8. An apparatus as in claim 1 where the first array of flexible actuators comprise at least a first flexible actuator and a different second flexible actuator.

9. An apparatus as in claim 8 where the respective piezoelectric members of the first and second flexible actuators comprise different resonance frequencies.

10. An apparatus as in claim 8 where the first and second flexible actuators are arranged in an intermixed pattern in the first array.

11. An apparatus as in claim 1 where the first array of flexible actuators comprise the flexible actuators being arranged equi-azimuthally spaced about the first member.

12. An apparatus as in claim 1 further comprising a second array of flexible actuators connected to the first member.

13. An apparatus as in claim 12 further comprising a separate second flexible membrane connected to the second array of flexible actuators, where the second flexible membrane is spaced from the first flexible membrane.

14. An apparatus as in claim 13 where the first and second flexible membranes are arranged in a stacked configuration relative to each other.

15. An apparatus as in claim 13 where the second membrane is larger than the first membrane.

16. An apparatus as in claim 1 where the first member is located in a housing of at least one of: a handheld electronic device, a mobile phone, a computer tablet, a computer laptop, a wireless communication device, or a handheld game controller for a game console.

17. An apparatus as in claim 1 further comprising controller configured to cause first voltage signals to be sent to first ones of the piezoelectric members.

18. An apparatus as in claim 17 where the controller is configured to cause different second voltage signals to be sent to second ones of the piezoelectric members at a same time that the controller causes the first voltage signals to be sent to the first piezoelectric members.

19. An apparatus as in claim 17 where the controller is configured to cause adjustment of phase of the first voltage signals to adjust directivity of sound from the apparatus.

20. An apparatus as in claim 17 where the controller is configured to cause the first voltage signals to be sent to the first array of flexible actuators to cause activation of the respective first piezoelectric members in a first mode or a second mode, where the first mode comprises voltage signals without a phase difference and the second mode comprises voltage signals with a phase difference.

21. An apparatus as in claim 20 where the controller is configured, with use of the first and second modes, to control a frequency response of the apparatus.

22. An apparatus comprising:

at least one processor; and at least one non-transitory memory including computer program code, the at least one memory and the computer program code configured to, with the at least one processor, cause the apparatus to:

provide a first voltage signal to a first piezoelectric member, where the first piezoelectric member is part of a first flexible actuator, where the first flexible actuator comprises a first extension connected to the first piezoelectric member at a first connection;

provide a second voltage signal to a second piezoelectric member, where the second piezoelectric member is part of a second flexible actuator, where the second flexible actuator comprises a second extension connected to the second piezoelectric member at a second connection;

where the first and second flexible actuators are connected, with the first and second extensions, to at least one flexible membrane, where the at least one flexible membrane is formed onto the first piezoelectric member, the first extension, the first connection, the second piezoelectric member, the second extension, and the second connection, and where the providing of the first and second voltage signals to the first and second piezoelectric members causes the first and second piezoelectric members to move, which causes the first and second extensions to move the at least one flexible membrane.

23. An apparatus as in claim 22 where the at least one memory and the computer program code are configured to, with the at least one processor, cause the apparatus to:

provide the first and second voltage signals to the first and second piezoelectric members at a same time.

24. An apparatus as in claim 22 where the at least one memory and the computer program code are configured to, with the at least one processor, cause the apparatus to:

provide the second voltage signal to the second piezoelectric member after the first voltage signal is provided to the first piezoelectric member with a crossover.

25. An apparatus as in claim 22 where the at least one memory and the computer program code are configured to, with the at least one processor, cause the apparatus to:

cause adjustment of phase of the first and second voltage signals to adjust directivity of sound from the at least one flexible membrane.

26. An apparatus as in claim 22 where the at least one memory and the computer program code are configured to, with the at least one processor, cause the apparatus to:

cause the first voltage signal to be provided to the first flexible actuator to cause activation of the first piezoelectric member in a first mode, and cause the second voltage signal to be provided to the second flexible actuator to cause activation of the second piezoelectric member in a second mode, where the first mode comprises voltage signals without a phase difference and the second mode comprises voltage signals with a phase difference.

27. An apparatus as in claim 26 where the at least one memory and the computer program code are configured to, with the at least one processor, cause the apparatus to:

use the first and second modes to control a frequency response of the at least one flexible membrane.

28. An apparatus as in claim 22 where the at least one flexible membrane comprises a first flexible membrane having the first flexible actuator connected thereto and a second flexible membrane having the second flexible actuator connected thereto, where the first and second flexible membranes are separate from each other.

* * * * *